US005517075A

United States Patent [19]

Vickers

[11] Patent Number: 5,517,075

[45] Date of Patent: May 14, 1996

[54] FIELD EMISSION DEVICE WITH DISTINCT SIZED APERTURES

[75] Inventor: Kenneth G. Vickers, Whitesboro, Tex.

[73] Assignee: Texas Instruments Incorporated, Dallas, Tex.

[21] Appl. No.: 544,678

[22] Filed: Oct. 18, 1995

Related U.S. Application Data

[63] Continuation of Ser. No. 235,039, Apr. 29, 1994, abandoned.

[51] Int. Cl.[6] ..... H01J 1/16; H01J 19/10

[52] U.S. Cl. ..... 313/336; 313/309; 313/351

[58] Field of Search ..... 313/336, 309, 313/351

[56] References Cited

U.S. PATENT DOCUMENTS

| | | | |
|---|---|---|---|
| 3,755,704 | 8/1973 | Spindt et al. | 313/309 |
| 4,857,161 | 8/1989 | Borel et al. | 204/192.26 |
| 4,940,916 | 7/1990 | Borel et al. | 313/306 |
| 5,063,327 | 11/1991 | Brodie et al. | 313/482 |
| 5,194,780 | 3/1993 | Meyer | 315/169.3 |
| 5,225,820 | 7/1993 | Clerc | 340/752 |
| 5,278,472 | 1/1994 | Smith et al. | 313/309 |

*Primary Examiner*—Donald J. Yusko
*Assistant Examiner*—Michael Day
*Attorney, Agent, or Firm*—Christopher L. Maginniss; W. James Brady, III; Richard L. Donaldson

[57] ABSTRACT

A size-arrayed emitter structure is disclosed for use in a field emission display device. The emitter structure is designed such that each emitter array (illustratively, an array comprising microtips 40 in a 5×5 matrix) has an emitter hole 52 size (critical dimension) distribution that is centered on the optimum hole critical dimension and extends past the point at which the emitter tip 40 will operate. If the manufacturing process varies and produces an actual critical dimension larger than the designed value, emitters with the designed critical dimensions smaller than optimal will shift toward optimal, and emitters with critical dimensions smaller than the minimum operating value will become operational, while emitters with designed critical dimensions larger than optimal will cease to function. Similarly, if the actual critical dimension is smaller than the designed value, emitters with the designed critical dimensions larger than optimal will shift toward optimal, and emitters with critical dimensions larger than the maximum operating value will become operational, while emitters with designed critical dimensions smaller than optimal will cease to function. This will result in a distribution of active emitters in each array that are centered on the optimal value and that extend from the minimum functional emitter critical dimension to the maximum functional emitter critical dimension. Where the number of emitter arrays per display pixel is relatively large, the critical dimension of all of the emitter holes within each array may be designed to be equal, and the totality of arrays within each pixel may be designed such that their emitter hole critical dimensions are centered on the optimum hole critical dimension and extend past the point at which the emitter tips will operate.

14 Claims, 2 Drawing Sheets

FIELD EMISSION DEVICE WITH DISTINCT SIZED APERTURES

This application is a continuation, of application Ser. No. 08/235,039, filed Apr. 29, 1994, now abandoned.

TECHNICAL FIELD OF THE INVENTION

The present invention relates generally to field emission flat panel displays and, more particularly, to an emitter structure which provides substantially constant emitter flux over processing variations.

BACKGROUND OF THE INVENTION

For more than half a century, the cathode ray tube (CRT) has been the principal electronic device for displaying visual information. The widespread usage of the CRT may be ascribed to the remarkable quality of its display characteristics in the realms of color, brightness, contrast and resolution. One major feature of the CRT permitting these qualities to be realized is the use of a luminescent phosphor coating on a transparent faceplate.

Conventional CRT's, however, have the disadvantage that they require significant physical depth, i.e., space behind the actual display surface, making them bulky and cumbersome. They are fragile and, due in part to their large vacuum volume, can be dangerous if broken. Furthermore, these devices consume significant amounts of power.

The advent of portable computers has created intense demand for displays which are light-weight, compact and power efficient. Since the space available for the display function of these devices precludes the use of a conventional CRT, there has been significant interest in efforts to provide satisfactory so-called "flat panel displays" or "quasi flat panel displays," having comparable or even superior display characteristics, e.g., brightness, resolution, versatility in display, power consumption, etc. These efforts, while producing flat panel displays that are useful for some applications, have not produced a display that can compare to a conventional CRT.

Currently, liquid crystal displays are used almost universally for laptop and notebook computers. In comparison to a CRT, these displays provide poor contrast, only a limited range of viewing angles is possible, and, in color versions, they consume power at rates which are incompatible with extended battery operation. In addition, color screens tend to be tar more costly than CRT's of equal screen size.

As a result of the drawbacks of liquid crystal display technology, thin film field emission display technology has been receiving increasing attention by industry. Flat panel displays utilizing such technology employ a matrix-addressable array of pointed, thin-film, cold field emission cathodes in combination with an anode comprising a phosphor-luminescent screen. The phenomenon of field emission was discovered in the 1950's, and extensive research by many individuals, such as Charles A. Spindt of SRI International, has improved the technology to the extent that its prospects for use in the manufacture of inexpensive, low-power, high-resolution, high-contrast, full-color flat displays appear to be promising.

Advances in field emission display technology are disclosed in U.S. Pat. No. 3,755,704, "Field Emission Cathode Structures and Devices Utilizing Such Structures," issued Aug. 28, 1973, to C. A. Spindt et al.; U.S. Pat. No. 4,857,161, "Process for the Production of a Display Means by Cathodoluminescence Excited by Field Emission," issued Aug. 15, 1989, to Michel Borel et al.; U.S. Pat. No. 4,940,916, "Electron Source with Micropoint Emissive Cathodes and Display Means by Cathodoluminescence Excited by Field Emission Using Said Source," issued Jul. 10, 1990 to Michel Borel et al.; U.S. Pat. No. 5,194,780, "Electron Source with Microtip Emissive Cathodes," issued Mar. 16, 1993 to Robert Meyer; and U.S. Pat. No. 5,225,820, "Microtip Trichromatic Fluorescent Screen," issued Jul. 6, 1993, to Jean-Frédéric Clerc. These patents are incorporated by reference into the present application.

One of the problems yet to be overcome is the ability to fabricate emitter microtips which provide constant display intensity despite processing variations. In the current technology, field emission cathodes are formed of a multiplicity of arrays, wherein each array includes a small cluster of microtips, illustratively twenty-five microtips. At each array a plurality of fixed-diameter holes are etched; the diameter of the hole influences the emitter microtip form and functionality. This emitter hole size is frequently referred to as the critical dimension. As the critical dimension of a hole changes due to processing variations, the emission from the microtip associated with that hole varies as well. This causes changes in the electron flux to the anode, resulting in variations in the display intensity. The range of emitter hole critical dimensions tier which acceptable microtip emission is achieved is quite narrow, and the transition between emission and no-emission is sharply defined.

Current solutions to this variable display intensity problem involve process control and equipment design techniques that attempt to prevent the etched critical dimension of the emitter array matrix from drifting from an optimal size. Acceptable display performance is limited by the emitter hole processing equipment capability, as any variation in the critical dimension across the display will result in a change in the emission characteristics of the display.

In view of the above, it is clear that there exists a need to develop an emitter structure which provides an improvement in the emitter flux uniformity over processing variations than is currently known in the art.

SUMMARY OF THE INVENTION

In accordance with the principles of the present invention, there is disclosed herein an electron emission apparatus which comprises a first conductive layer and an insulating layer on the first conductive layer. The apparatus also comprises a second conductive layer on the insulating layer, the second conductive layer having a plurality of apertures extending therethrough and through the insulating layer, and means for applying a potential between the first and second conductive layers. Finally, the electron emission apparatus comprises microtip emitters on the first conductive layer, each emitter formed within a corresponding one of the apertures in the second conductive layer, the apertures in the second conductive layer being of more than one size, such that a potential applied between the first and second conductive layers produces electron emission from at least one of the emitters but less than all of the emitters.

In accordance with a preferred embodiment of the present invention, the apertures in the second conductive layer are grouped in arrays, each array including apertures of more than one size, such that a potential applied between the first and second conductive layers produces electron emission from at least one emitter in the array but less than all emitters in the array. Further in accordance with the preferred embodiment, the apertures in each array of the second conductive layer range in size such that a substantially equal number of emitters in each array produce electron emission in response to the potential applied between the first and second conductive layers, despite variations in the processing steps which produce the apparatus.

Further in accordance with the present invention, there is disclosed a method for forming an electron emission apparatus comprising the steps of providing a first conductive layer on an insulating substrate, forming an insulating layer on the first conductive layer, and forming a second conductive layer on the insulating layer. The method comprises the additional steps of forming a plurality of apertures through the second conductive layer and through the insulating layer, the apertures being of more than one size, and forming a microtip emitter on the first conductive layer within each one of the plurality of apertures in the second conductive layer, the apertures in the second conductive layer being sized such that a potential applied between the first and second conductive layers will produce electron emission from at least one of the emitters but less than all of the emitters.

BRIEF DESCRIPTION OF THE DRAWING

The foregoing features of the present invention may be more fully understood from the following detailed description, read in conjunction with the accompanying drawings, wherein.

DESCRIPTION OF THE PREFERRED EMBODIMENT

Figure 1:
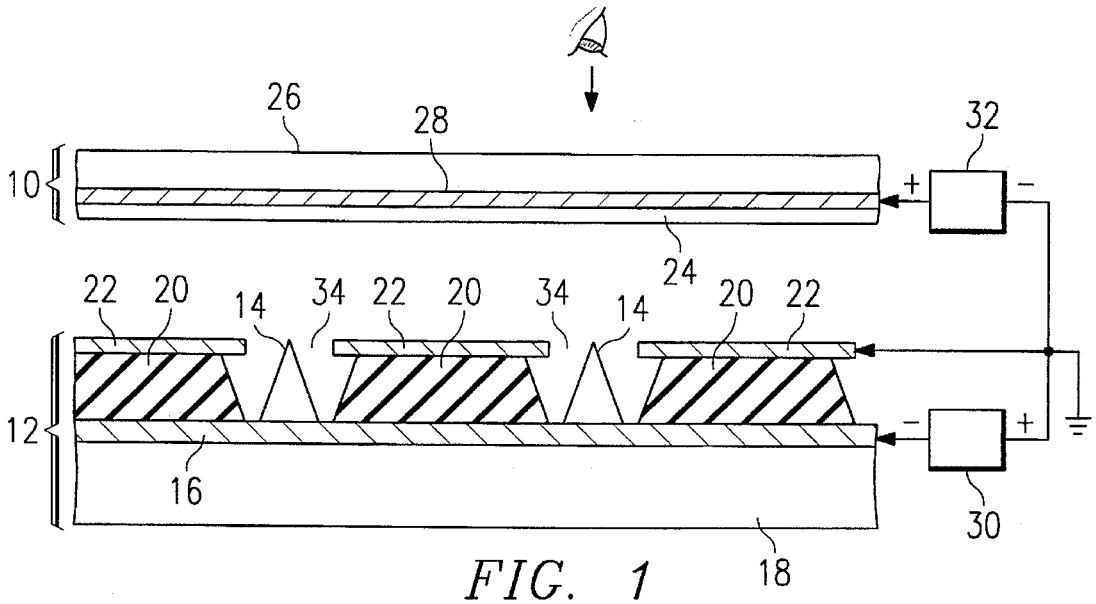
FIG. 1 (PRIOR ART)
FIG. 1 is a cross-sectional view of a portion of a field emission device in accordance with the prior art.

Referring initially to FIG. 1, there is shown, in cross-sectional view, a portion of an illustrative field emission device in which the present invention may be incorporated. In this embodiment, the field emission device comprises an anode plate having an electroluminescent phosphor coating facing an emitter plate, the phosphor coating being observed from the side opposite to its excitation.

More specifically, the field emission device of FIG. 1 comprises a cathodoluminescent anode plate 10 and an electron emitter (or cathode) plate 12. Emitter plate 12 includes a cathode electrode which comprises a multiplicity of electrically conductive microtips 14 formed on an electrically conductive layer 16, which is itself formed on an electrically insulating substrate 18. Layer 16 may be semiconducting or resistive instead of being conducting.

A gate electrode comprises a layer of an electrically conductive material 22 which is deposited on an insulating layer 20. Microtips 14 take the shape of cones which are formed within apertures through conductive layer 22 and insulating layer 20. The thicknesses of gate electrode layer 22 and insulating layer 20 are chosen in such a way that the apex of each microtip 14 is substantially level with the electrically conductive gate electrode layer 22. Conductive layer 22 may be in the form of a continuous layer across the surface of substrate 18; alternatively, it may comprise conductive bands across the surface of substrate 18.

Anode plate 10 comprises a transparent, electrically conductive film 28 deposited on a transparent planar support 26, which is positioned facing gate electrode 22 and parallel thereto, the conductive film 28 being deposited on the surface of support 26 directly facing gate electrode 22. Conductive film 28 may be in the form of a continuous layer across the surface of support 26; alternatively, it may be in the form of electrically isolated stripes comprising three series of parallel conductive bands across the surface of support 26, as taught in U.S. Pat. No. 5,225,820, to Clerc. By way of example, a suitable material for use as conductive film 28 may be indium-tin-oxide (ITO), which is optically transparent and electrically conductive. Anode plate 10 also comprises a cathodoluminescent phosphor coating 24, deposited over conductive film 28 so as to be directly facing and immediately adjacent gate electrode 22. In the Clerc patent, the conductive bands of each series are covered with a particulate phosphor coating which luminesces in one of the three primary colors, red, blue and green.

Selected groupings of microtip emitters 14 of the above-described structure are energized by applying a negative potential to layer 16, functioning as the cathode electrode, relative to the gate electrode 22, via voltage supply 30, thereby inducing an electric field which draws electrons from the apexes of microtips 14. The freed electrons are accelerated toward the anode plate 10 which is positively biased by the application of a substantially larger positive voltage from voltage supply 32 coupled between the gate electrode 22 and conductive film 28 functioning as the anode electrode. Energy from the electrons attracted to the anode conductive film 28 is transferred to particles of the phosphor coating 24, resulting in luminescence. The electron charge is transferred from phosphor coating 24 to conductive film 28, completing the electrical circuit to voltage supply 32.

Figure 2:
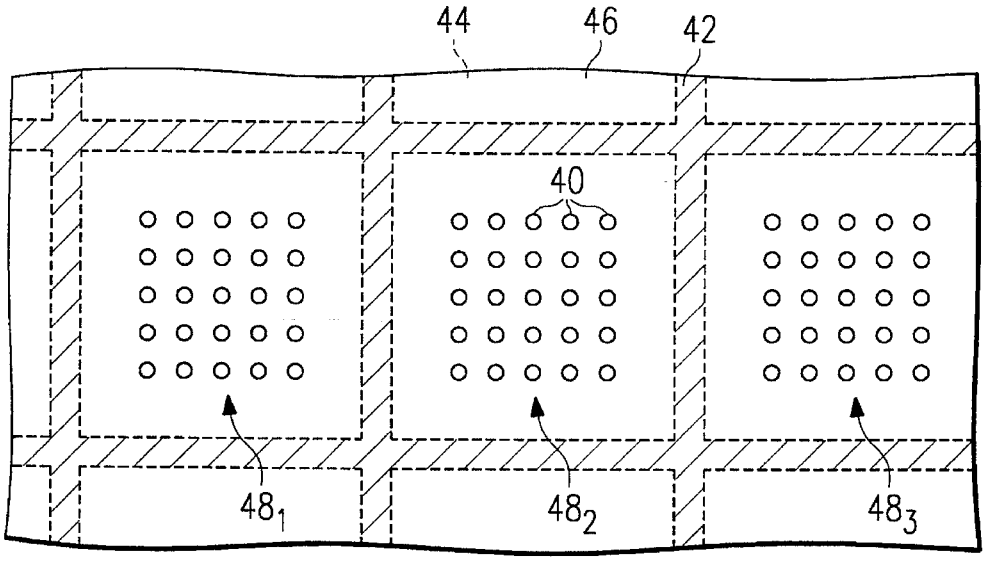
FIG. 2 (PRIOR ART)
FIG. 2 illustrates a typical matrix of emitters in five-by-five arrays which may be used in the device of FIG. 1.

The Meyer ('780) patent discloses a microtip emissive cathode electron source wherein the cathode and/or gate conductors are formed in a mesh structure, and the microtip emitters are arranged in an array within the mesh spacings. In this disclosure, the individual cathodes and/or gates of the matrix emitters are coupled to their respective conductors by an electrically resistive layer. A top view of an illustrative matrix of emitters is shown in FIG. 2, wherein five-by-five arrays of emitters 40 are arranged within the spacings formed by a mesh of electrically conductive material 42, comprising the cathode conductor. The spacings between conductive mesh 42 are filled with an electrically resistive material 44, which provides a resistive path between the microtip emitters 40 and conductive mesh 42. The top layer 46 of the structure depicted in FIG. 2 is the control or gate electrode, which, in this embodiment, is a continuous conductive sheet perforated at each emitter location 40.

Referring once again to the illustration of FIG. 1, the Borel et al. ('161) patent discloses an etching process for forming the holes 34 in the gate electrode material coating 22 and the insulating layer 20. In this example, the conductive gate electrode material coating 22 is made of niobium and is 0.4 micron in thickness. Also, in this example, insulating layer 20 is made of silicon dioxide and is 1.0 micron in thickness. The described process includes a reactive ionic etching of conductive coating 22 and insulating layer 20 using a sulfur hexafluoride ($SF_6$)plasma to form holes 34. The insulating layer 20 is then undercut by chemical etching, e.g., by immersing the structure in a hexafluoric acid and ammonium fluoride etching solution. The microtip emitters 14 are formed by first depositing a nickel coating by vacuum evaporation at a glancing angle with respect to the surface of the structure, thus ensuring that the holes 34 do not become blocked, while assuring complete coverage of the niobium hole edges. This is followed by the deposition of a molybdenum coating on the complete structure at a normal to slight angle incidence, thereby forming the cone-shaped emitters 14 within holes 34. The nickel coating is then selectively dissolved by an electrochemical process so as to expose the perforated conductive coating 22 and bring about the appearance of the electron emitting microtips 14.

Figure 3:
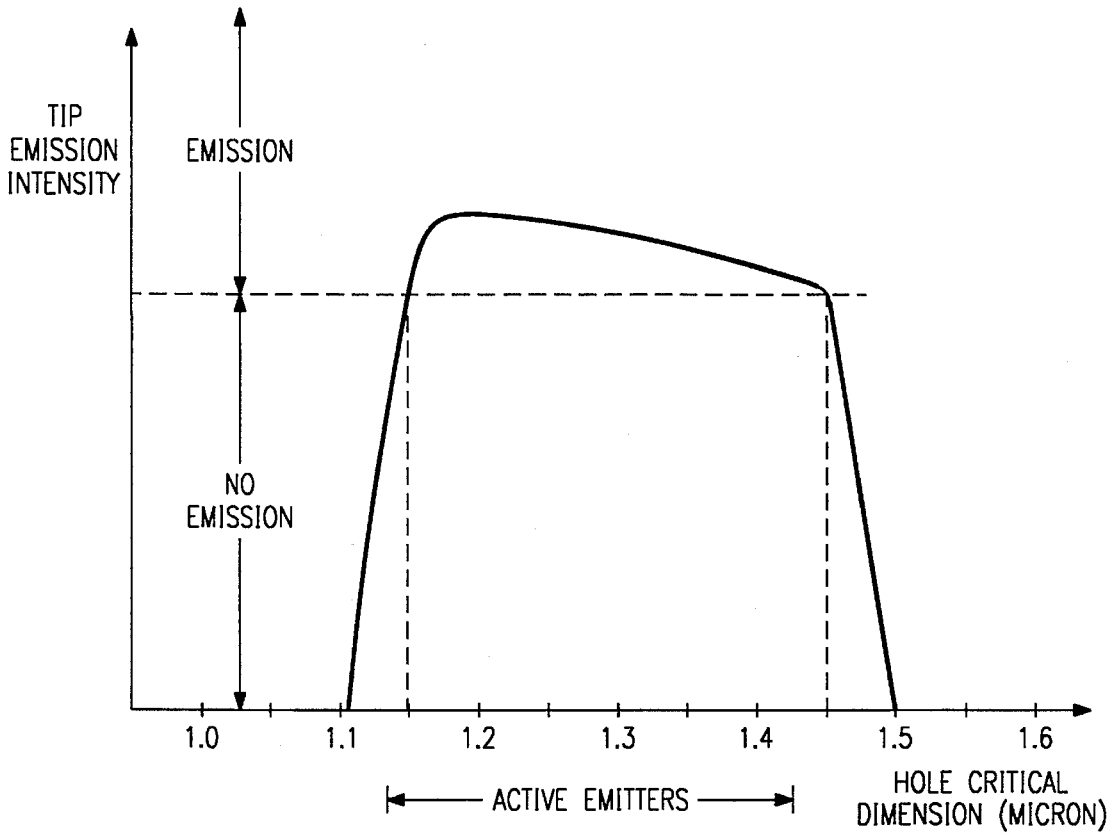
FIG. 3 is a plot of tip emission intensity over a range of emitter hole sizes.

The Borel et al. ('161) patent specifies that holes 34 made in the conductive coating 22 must have a diameter of 1.3±0.1 microns. The diameter of hole 34 through conductive coating 22 affects the form of the microtip 14 formed therein. Since the form of microtip 14, along with the size of hole 34, determines its emission characteristics, the diameter of hole 34 through conductive coating 22 is therefore referred to as the critical dimension. The criticality of this dimension and its accompanying limitation may be understood from FIG. 3, which provides an illustrative plot of tip emission intensity over a range of emitter hole sizes. This plot illustrates that emitters which are formed in holes having diameters which are between 1.15 and 1.45 microns may be active, and that there will no be emission from microtip emitters which are formed in holes which are greater than 1.45 microns or which are less than 1.15 microns.

Figure 4:
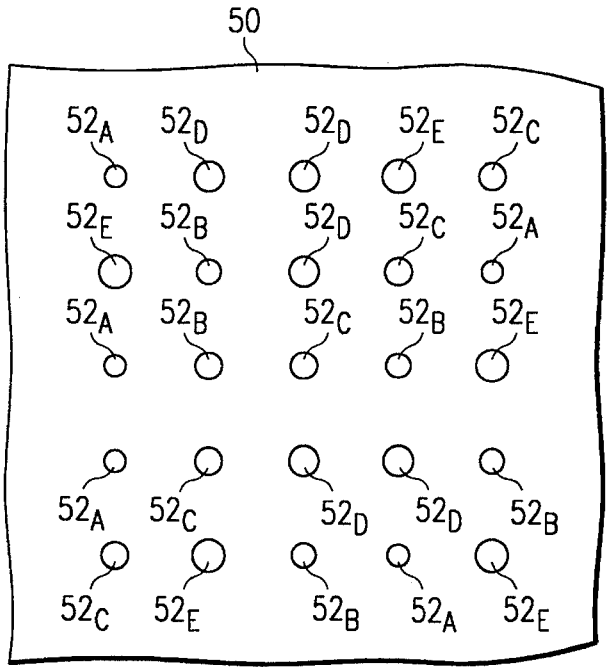
FIG. 4 depicts an illustrative size-arrayed emitter matrix in accordance with the present invention for use in the field emission device of FIG. 1.

In accordance with the principles of the present invention, FIG. 4 depicts a portion of an illustrative size-arrayed emitter structure for use in the field emission device of FIG. 1. The emitter structure is designed such that each emitter array (illustratively, an array comprising microtips in a 5×5 matrix) has an emitter hole size (critical dimension) distribution that is centered on the optimum hole critical dimension and extends past the point at which the emitter tip will operate. If the manufacturing process varies and produces an actual critical dimension larger than the designed value, emitters with the designed critical dimensions smaller than optimal will shift toward optimal, and emitters with critical dimensions smaller than the minimum operating value will become operational, while emitters with designed critical dimensions larger than optimal will cease to function. Similarly, if the manufacturing process varies and produces an actual critical dimension smaller than the designed value, emitters with the designed critical dimensions larger than optimal will shift toward optimal, and emitters with critical dimensions larger than the maximum operating value will become operational, while emitters with designed critical dimensions smaller than optimal will cease to function. This will result in a distribution of active emitters in each array that are centered on the optimal value and that extend from the minimum functional emitter critical dimension to the maximum functional emitter critical dimension.

Referring again to FIG. 4, an illustrative emitter array structure may comprise twenty-five emitters in a square, five-by-five matrix. The emitters may be formed according to the above-described process, in an emitter structure comprising an electrically conductive material 50 having a five-by-five arrangement of holes 52 therein, wherein the microtip emitters (not shown) which are formed within some of the holes, denoted $\mathbf{52}_A$, are non-emitting because their critical dimensions are smaller than the minimum size required for emission. The microtip emitters (not shown) which are formed within yet others of the holes, denoted $\mathbf{52}_B$, are capable of emission because their critical dimensions are within the range of sizes required for emission, albeit near the lower end of the range. The microtip emitters (not shown) which are formed within others of the holes, denoted $\mathbf{52}_C$, are capable of emission because their critical dimensions are centered within the range of sizes required for emission. The microtip emitters (not shown) which are formed within still others of the holes, denoted $\mathbf{52}_D$, are capable of emission because their critical dimensions are within the range of sizes required for emission, albeit near the upper end of the range. Finally, the microtip emitters (not shown) which are formed within the remaining holes, denoted $\mathbf{52}_E$, are non-emitting because their critical dimensions are larger than the maximum size required for emission.

The example which follows applies numerical values to the above-described embodiment:

EXAMPLE

In accordance with the foregoing teachings, an illustrative size-arrayed, five-by-five matrix, such as the structure shown in FIG. 4, is designed such as to provide hole critical dimensions (in microns) as follows:

TABLE 1

| | | | | |
|---|---|---|---|---|
| 1.1 | (1.4) | (1.4) | 1.5 | (1.3) |
| 1.5 | (1.2) | (1.4) | (1.3) | 1.1 |
| 1.1 | (1.2) | (1.3) | (1.2) | 1.5 |
| 1.1 | (1.3) | (1.4) | (1.4) | (1.2) |
| (1.3) | 1.5 | (1.2) | 1.1 | 1.5 |

Using the earlier-mentioned criterion that microtip emitters formed within holes whose critical dimensions are between 1.2 and 1.4 microns will be active, and emitters formed within holes whose critical dimensions are outside that range will be inactive, it is seen that, if the field emission device is fabricated precisely according to design such that the actual etched matrix corresponds to the dimensions of TABLE 1, there will be five emitter holes of 1.2 microns, five emitter holes of 1.3 microns, and five emitter holes of 1.4 microns, all fifteen of which may be active. The active emitter positions in TABLE 1 are shown within parentheses (). It will also be seen that there are five emitter holes of 1.1 microns and five emitter holes of 1.5 microns, all ten of which will be inactive.

However, if the field emission device designed according to TABLE 1 is fabricated such that manufacturing or process variations result in a +0.1 micron shift, the actual etched matrix will have hole critical dimensions as follows:

TABLE 2

| | | | | |
|---|---|---|---|---|
| (1.2) | 1.5 | 1.5 | 1.6 | (1.4) |
| 1.6 | (1.3) | 1.5 | (1.4) | (1.2) |
| (1.2) | (1.3) | (1.4) | (1.3) | 1.6 |
| (1.2) | (1.4) | 1.5 | 1.5 | (1.3) |
| (1.4) | 1.6 | (1.3) | (1.2) | 1.6 |

In this case, there will be five emitter holes of 1.2 microns, five emitter holes of 1.3 microns, and five emitter holes of 1.4 microns, all fifteen of which may be active. The active emitter positions in TABLE 2 are shown within parentheses (). It will also be seen that there are five emitter holes of 1.5 microns and five emitter holes of 1.6 microns, all ten of which will be inactive.

Furthermore, if the field emission device designed according to TABLE 1 is fabricated such that manufacturing or process variations result in a −0.1 micron shift, the actual etched matrix will have hole critical dimensions as follows:

TABLE 3

| | | | | |
|---|---|---|---|---|
| 1.0 | (1.3) | (1.3) | (1.4) | (1.2) |
| (1.4) | 1.1 | (1.3) | (1.2) | 1.0 |
| 1.0 | 1.1 | (1.2) | 1.1 | (1.4) |
| 1.0 | (1.2) | (1.3) | (1.3) | 1.1 |
| (1.2) | (1.4) | 1.1 | 1.0 | (1.4) |

In this case, there will be five emitter holes of 1.2 microns, five emitter holes of 1.3 microns, and five emitter holes of 1.4 microns, all fifteen of which may be active. The active emitter positions in TABLE 3 are shown within parentheses (). It will also be seen that there are five emitter holes of 1.0 microns and five emitter holes of 1.1 microns, all ten of which will be inactive.

In each case, there are fifteen active emitters and ten inactive emitters, providing constant emission flux in spite of moderate processing variations which may increase or decrease the critical dimensions of the holes in which the microtip emitters are formed.

In the current technology, electron emitter plates are being fabricated with very high densities of microtip emitters, illustratively, where each display pixel includes in excess of 2,000 emitters. Considering the five-by-five matrix arrangement shown in FIG. 2, this large number of emitters requires close to one hundred such arrays for each display pixel. For the case of a four-by-four matrix of emitters, the number of arrays per display pixel greatly exceeds one hundred.

In these cases where the number of emitter arrays per display pixel is relatively large, the present invention is intended to include the case where the critical dimension of all of the emitter holes within each array are be designed to be equal, and the totality of arrays within each pixel are designed such that their emitter hole critical dimensions are centered on the optimum hole critical dimension and extend past the point at which the emitter tips will operate. As an example, referring to FIG. 2, all of the emitter holes 40 of array $\mathbf{48}_1$ may be designed to have equal critical dimensions, all of which are smaller than the optimum hole critical dimension; all of the emitter holes 40 of array $\mathbf{48}_2$ may be designed to have equal critical dimensions, all of which are equal to the optimum hole critical dimension; and all of the emitter holes 40 of array $\mathbf{48}_3$ may be designed to have equal critical dimensions, all of which are larger than the optimum hole critical dimension. In this example in which the emitter holes within each array are of equal size, the distribution of design critical dimensions within each pixel is preferably such that approximately sixty percent of the emitters of a pixel are active, similar to the above-cited examples of critical dimension distributions within each array, thereby providing constant emission flux in spite of moderate processing variations which may increase or decrease the critical dimensions of the holes in which the microtip emitters are formed.

The size-arrayed emitter structure, as illustrated in FIG. 4 and as described above, overcomes certain limitations of prior art approaches. The structure assures that the mean of the array or pixel will be fixed because the original array or pixel is designed with emitter critical dimensions that are beyond the critical dimensions that will create functional emitters. As the etched critical dimension drifts away from its design value, some of emitters at the dimensional extremes will become active while others on the opposite end of the distribution will become inactive.

The emitter structure in accordance with the present invention allows some amount of equipment drift before the magnitude of emission flux of the emitter array changes. As such, no change in display intensity will be visible to the viewer until the emitter array size changes significantly. It is believed that the equipment and process capabilities of current production equipment are sufficiently controlled that the etched emitter critical dimensions achieved in production will not extend beyond the point that the array emission will change. The emitter structure in accordance with the present invention is expected to improve manufacturing by reducing reworks at the critical dimension photo step, and by reducing the scrap at the etch step. Hence, for the application of field emission to flat panel displays as envisioned here, this approach to a size-arrayed emitter structure in accordance with the present invention provides a significant advantage.

While the principles of the present invention have been demonstrated with particular regard to the structure and method disclosed herein, it will be recognized that various departures may be undertaken in the practice of the invention. The scope of the invention is not intended to be limited to the particular structure and method disclosed herein, but should instead be gauged by the breadth of the claims which follow.

What is claimed is:

1. Electron emission apparatus comprising:

a first conductive layer;

an insulating layer on said first conductive layer;

a second conductive layer on said insulating layer, said second conductive layer having apertures extending therethrough and through said insulating layer;

means for applying a potential between said first and second conductive layers; and microtip emitters on said first conductive layer, each emitter formed within a corresponding one of said apertures in said second conductive layer, said apertures in said second conductive layer being formed of a plurality of distinct sizes, such that said potential applied between said first and second conductive layers produces electron emission from emitters within apertures of at least one but not all of said distinct sizes.

2. The electron emission apparatus in accordance with claim 1 wherein said apertures in said second conductive layer are grouped in arrays, each array including apertures formed of said plurality of distinct sizes, such that said potential applied between said first and second conductive layers produces electron emission from emitters within apertures of at least one but not all of said distinct sizes in said array.

3. The electron emission apparatus in accordance with claim 2 wherein each array includes an equal number of apertures.

4. The electron emission apparatus in accordance with claim 1 wherein optimal electron emission is provided by a predetermined size of aperture in said second conductive layer, said apertures in said second conductive layer including at least one aperture substantially equal in size to said predetermined size and at least one aperture of a different size.

5. The electron emission apparatus in accordance with claim 1 wherein optimal electron emission is provided by a predetermined size of aperture in said second conductive layer, the range of said plurality of distinct sizes of said apertures in said second conductive layer being such that at least one aperture is substantially equal in size to said predetermined size despite variations in the processing steps which produce said apparatus.

6. An electron emission display apparatus comprising:

an emitter structure including an insulating substrate, a first conductive layer on said substrate, an insulating layer on said first conductive layer, a second conductive layer on said insulating layer, said second conductive layer having apertures extending therethrough and through said insulating layer, said apertures being grouped in arrays, means for applying a first potential between said first and second conductive layers, and microtip emitters on said first conductive layer, each emitter formed within a corresponding one of said apertures in said second conductive layer, said apertures in each array being formed of said plurality of distinct sizes, such that said first potential applied between said first and second conductive layers produces electron emission from emitters within apertures of at least one but not all of said distinct sizes in each array;

a display panel having a substantially planar face opposing said second conductive layer, said display panel including an anode electrode with a cathodoluminescent coating on said planar face; and means for applying a second potential between said anode electrode and said second conductive layer.

7. The electron emission display apparatus in accordance with claim 6 wherein each array includes an equal number of apertures.

8. The electron emission display apparatus in accordance with claim 6 wherein optimal electron emission is provided by a predetermined size of aperture in said second conductive layer, said apertures in each array of said second conductive layer including at least one aperture substantially equal in size to said predetermined size and at least one aperture of a different size.

9. The electron emission display apparatus in accordance with claim 6 wherein optimal electron emission is provided by a predetermined size of aperture in said second conductive layer, the range of said plurality of distinct sizes of said apertures in said second conductive layer being such that at least one aperture in each array is substantially equal in size to said predetermined size despite variations in the processing steps which produce said apparatus.

10. Electron emission apparatus comprising:

an insulating substrate;

a conductor formed as a mesh structure on said substrate, said mesh structure defining mesh spaces;

a layer of an electrically resistive material on said substrate overlaying said mesh structure;

an insulating layer on said layer of electrically resistive material;

a conductive layer on said insulating layer, said conductive layer having apertures extending therethrough and through said insulating layer within a mesh space;

means for applying a potential between said mesh structure and said conductive layer; and microtip emitters on said layer or electrically resistive material, each emitter formed within a corresponding one of said apertures in said conductive layer, said apertures in said conductive layer being formed of a plurality of distinct sizes, such that said potential applied between said mesh structure and said conductive layer produces electron emission from emitters within apertures of at least one but not all of said distinct sizes.

11. The electron emission apparatus in accordance with claim 10 wherein said apertures in said conductive layer are grouped in a plurality of arrays, each one of said plurality of arrays formed within a corresponding mesh space, each array including apertures formed of said plurality of distinct sizes, such that said potential applied between said mesh structure and said conductive layer produces electron emission from emitters within apertures of at least one but not all of said distinct sizes in each array.

12. The electron emission apparatus in accordance with claim 11 wherein each array includes an equal number of apertures.

13. The electron emission apparatus in accordance with claim 10 wherein optimal electron emission is provided by a predetermined size of aperture in said conductive layer, said apertures in said conductive layer including at least one aperture substantially equal in size to said predetermined size and at least one aperture of a different size.

14. The electron emission apparatus in accordance with claim 10 wherein optimal electron emission is provided by a predetermined size of aperture in said conductive layer, the range of said plurality of distinct sizes of said apertures in said conductive layer being such that at least one aperture is substantially equal in size to said predetermined size despite variations in the processing steps which produce said apparatus.

* * * * *